United States Patent [19]

Cappuzzo et al.

[11] Patent Number: 4,944,393

[45] Date of Patent: Jul. 31, 1990

[54] ANIMAL REPELLENT TRASH BAG

[76] Inventors: Doris J. Cappuzzo, 19813 E. 47th Terr. Ct.; John D. Cappuzzo, 2812 S. 5th, both of, Blue Springs, Mo. 64015

[21] Appl. No.: 360,056

[22] Filed: Jun. 1, 1989

[51] Int. Cl.[5] ..... B65D 30/22; B65D 33/28

[52] U.S. Cl. ..... 206/205; 206/532; 383/40; 383/75

[58] Field of Search ..... 206/205, 532; 383/40, 383/75; 428/907; 220/87, 1 T

[56] References Cited

U.S. PATENT DOCUMENTS

| | | | |
|---|---|---|---|
| 3,653,583 | 4/1972 | Meyer | 383/75 X |
| 3,702,677 | 11/1972 | Heffington | 206/205 X |
| 3,955,706 | 5/1976 | Whitaker | 220/87 |
| 4,105,144 | 8/1978 | Lin | 206/205 X |
| 4,202,472 | 5/1980 | Lin | 206/205 X |
| 4,274,123 | 6/1981 | Rogers et al. | 361/232 |
| 4,320,112 | 3/1982 | Jones et al. | 424/412 |
| 4,349,104 | 9/1982 | Hayes | 206/205 |
| 4,558,463 | 12/1985 | Boyd | 383/75 |
| 4,558,796 | 12/1985 | Jaicks | 220/1 T |
| 4,628,007 | 12/1986 | Ledsham | 220/1 T X |
| 4,666,054 | 5/1987 | Jaicks | 220/1 T |

*Primary Examiner*—Stephen Marcus
*Assistant Examiner*—Jes F. Pascua
*Attorney, Agent, or Firm*—Leon Gilden

[57] ABSTRACT

An animal repellent trash bag is set forth wherein a flexible bag includes a drawstring contained within a conduit defined by an overlapped layer developed about an uppermost edge of the bag. Adhesively secured to an interior surface of the bag is a tear-away strip overlying a quantity of animal repellent granules, wherein the granules are deposited interiorly of the bag upon removal of the tear strip to thwart animal tampering with the trash bag. A quantity of the granules are adhesively secured onto an interior surface of the bag to maintain the particles in orientation medially of the bag. A modification provides the tear strip overlying the drawstring conduit wherein the granules are maintained within the drawstring conduit and upon removal of the peel-away layer a series of apertures are exposed to fit into the drawstring conduit to permit seeping of the granules overlying the contents positioned within the bag.

1 Claim, 3 Drawing Sheets

Fig 4
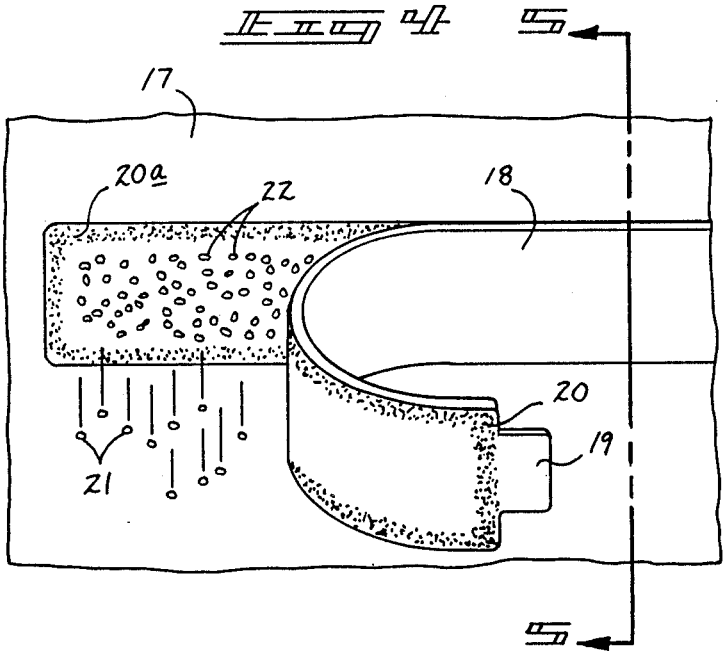
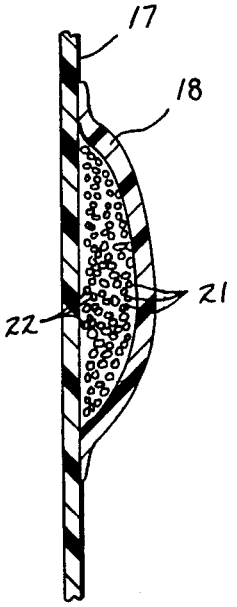
Fig 5

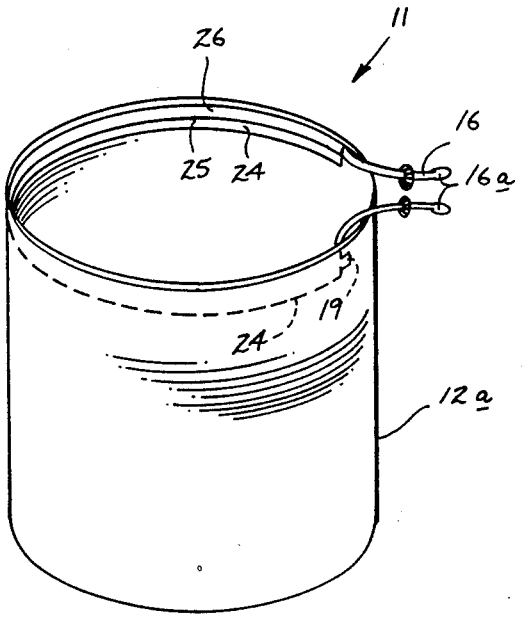
Fig 6
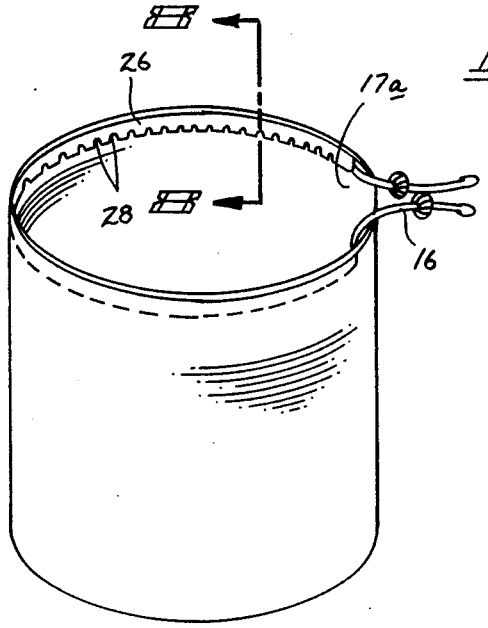
Fig 7
Fig 8
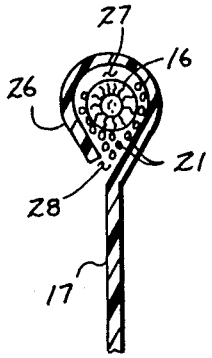

ANIMAL REPELLENT TRASH BAG

BACKGROUND OF THE INVENTION

1. Field of the Invention

The field of invention relates to trash bags, and more particularly pertains to a new and improved trash bag incorporating animal repellent means within the bag to discourage animals tampering with the bag.

2. Description of the Prior Art

The use of animal repellent to discourage an animal tampering with a bag is known in the prior art. There is a need to prevent the unnecessary cleanup and unsanitary strewing of litter about an area upon an animal tampering and destroying a trash bag to gain entry into the contents therein. The prior art has failed to provide a desirable animal repellent to orient the repellent as needed in relation to the trash bag to prevent such tampering. For example, U.S. Pat. No. 4,320,112 to Jones, et al., sets forth a receptacle employing an animal repellent to prevent entry therein by a pest, such as an animal. The patent, however, fails to orient the animal repellent material in an effective position interiorly of the bag to effectively neutralize odors and provide an animal repellent means interiorly of the bag as needed.

U.S. Pat. No. 3,955,706 to Whitaker sets forth a waste container provided with a built-in deodorizing material that may be affixed to an interior surface of the rigid waste container.

U.S. Pat. No. 4,274,123 to Rogers sets forth an animal repellent utilizing electric shock to discourage an animal from entering an undesired area.

U.S. Pat. No. 4,558,796 to Jaicks sets forth a storage container utilizing a uniquely sealed lid to prevent access interiorly thereof by an animal.

U.S. Pat. No. 4,666,054 to Jaicks sets forth a garbage storage container utilizing a threadedly mounted lid to prevent access interiorly thereof by an animal in a similar manner as the Jaicks patent 4,558,796.

As such, it may be appreciated that there is a continuing need for a new and improved animal repellent trash bag wherein the same provides for the deposit of animal repellent and deodorizing material as desired to overlie refuse within the bag and maintain the repellent at a predetermined vertical orientation within the bag.

SUMMARY OF THE INVENTION

In view of the foregoing disadvantages inherent in the known types of refuse container organizations now present in the prior art, the present invention provides an animal repellent trash bag wherein the same provides for a flexible trash bag with a selectively releasable magazine supply of animal repellent and deodorizing material for deposit interiorly of the bag. As such, the general purpose of the present invention, which will be described subsequently in greater detail, is to provide a new and improved animal repellent trash bag which has all the advantages of the prior art refuse containers and none of the disadvantages.

To attain this, the present invention comprises a flexible polymeric bag defining an opening with an overfolded layer to form a conduit about a major perimeter of the opening with a drawstring directed therethrough. Adhesively secured to an interior surface of the bag is a tear-away strip defining an interior compartment to selectively maintain a quantity of animal repellent and deodorizing granules therein with a portion of the granules adhesively secured to the bag to maintain the granules in a predetermined orientation relative to the bag. A modification of the instant invention includes a tear-away strip overlying the overfolded layer defining the conduit wherein the conduit houses the aforenoted granules, whereupon removal of the tear-away strip reveals a series of apertures to permit seepage of the granules to overlie the trash bag contents.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved animal repellent trash bag which has all the advantages of the prior art refuse containers and none of the disadvantages.

It is another objects of the present invention to provide a new and improved animal repellent trash bag which may be easily and efficiently manufactured and marketed.

It is a further object of the present invention to provide a new and improved animal repellent trash bag which is of a durable and reliable construction.

An even further object of the present invention is to provide a new and improved animal repellent trash bag which is susceptible of a low cost of manufacture with regard to both materials and labor, and which accordingly is then susceptible of low prices of sale to the consuming public, thereby making such animal repellent trash bags economically available to the buying public.

Still yet another object of the present invention is to provide a new and improved animal repellent trash bag which provides in the apparatuses and methods of the prior art some of the advantages thereof, while simultaneously overcoming some of the disadvantages normally associated therewith.

Still another object of the present invention is to provide a new and improved animal repellent trash bag wherein the same enables a deposit of animal repellent and deodorizing granules to overlie the contents deposited within the trash bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration, somewhat enlarged, of the tear-away strip partially delaminated from an interior surface of the trash bag.

FIG. 5 is an orthographic view taken along the lines 5—5 of FIG. 4 in the direction indicated by the arrows.

FIG. 6 is an isometric illustration of a modification of the instant invention.

FIG. 7 is an isometric illustration of the tear-away strip removed from the modification, as illustrated in FIG. 6.

FIG. 8 is an orthographic view taken along the lines 8—8 of FIG. 7 in the direction indicated by the arrows.

DESCRIPTION OF THE PREFERRED EMBODIMENT

Figure 1:
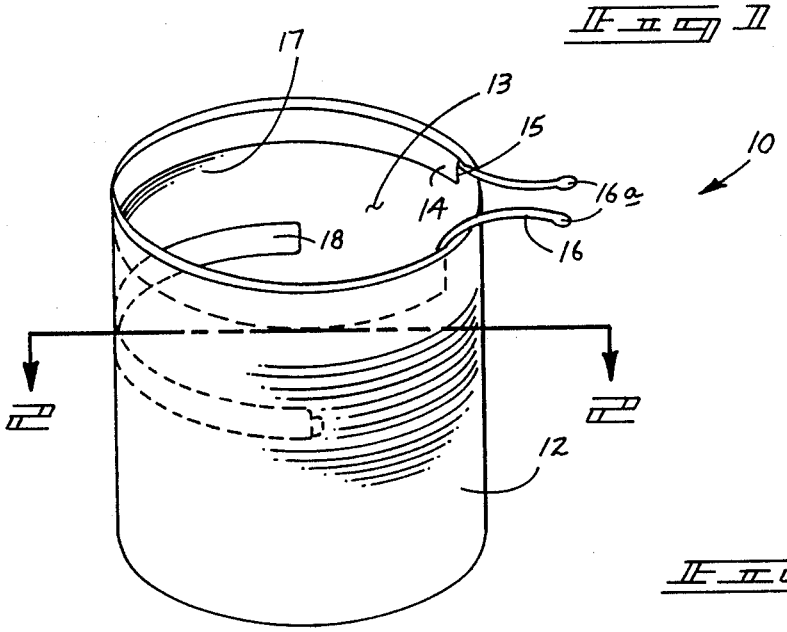
FIG. 1 is an isometric illustration of the instant invention.
Figure 2:
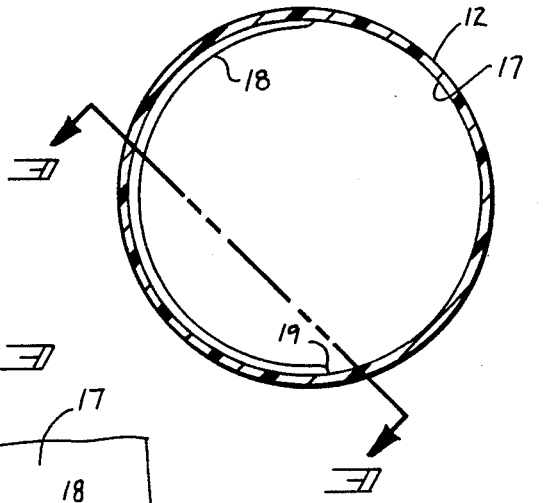
FIG. 2 is an orthographic view taken along the lines 2—2 of FIG. 1 in the direction indicated by the arrows.
Figure 3:
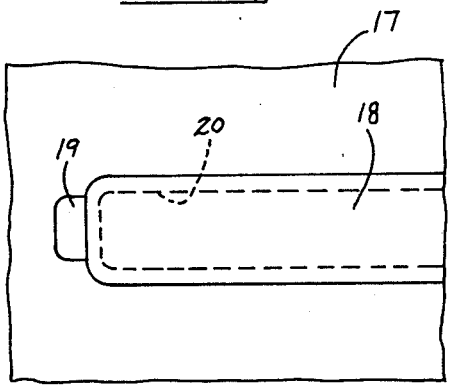
FIG. 3 is an orthographic view taken along the lines 3—3 of FIG. 2 in the direction indicated by the arrows.

With reference now to the drawings, and in particular to FIGS. 1 to 8 thereof, a new and improved animal repellent trash bag embodying the principles and concepts of the present invention and generally designated by the reference numerals 10 and 11 will be described.

More specifically, it will be noted that the animal repellent trash bag 10 essentially comprises a flexible polymeric trash bag 12 defining an upper opening 13. The opening 13 includes an overfolded layer 14, selectively heat seamed or adhesively secured to an interior surface 17 of the bag 12, to form a discontinuous conduit 15 about a major portion adjacent the opening 13. The conduit 15 includes a drawstring 16 formed with terminal ends **16*a*** for securement of the bag.

The interior surface 17 of the bag 12 includes a cover strip 18 provided with a first adhesive perimeter 20 formed about a perimeter of the cover strip 18 securable to a second adhesive perimeter **20*a* of a complementary configuration to the first adhesive perimeter 20 formed about the interior surface of the bag 17 medially of the vertical height of the bag 12. The cover strip 18 forms a compartment, as illustrated in FIG. 5, containing a quantity of respective first and second deodorizing and animal repellent granules 21 and 22. The first granules 21 are freely distributed interiorly of the bag upon removal of the cover strip 18 by manual application of force to the pull tab 19 integrally secured to and directed outwardly of an edge of the cover strip 18. The second particles 22 are similar in chemical composition to the first particles 21, but are adhesively adhered to the interior surface of the bag 17 to maintain a deodorizing animal repellent effect at a predetermined vertical height above the associated floor of the bag 12**.

Attention to FIGS. 6 and 7 illustrates a modified version application wherein the modified animal repellent trash bag 11 includes a modified cover strip 24 overlying the overfolded layer 26 of the trash bag that defines the conduit 27 interiorly thereof for acceptance of the drawstring 16 therein. The modified cover strip 24 includes an upper adhesively secured covering edge 25 wherein the entire cover strip is adhesively secured to overlie the overfolded layer 26 and the interior surface of the bag **12*a*, whereupon removal of the modified cover strip 24 exposes a series of apertures 28, as illustrated in FIGS. 7 and 8. The apertures 28 enable the granules 21 to seep onto contents positioned within the interior volume of the trash bag 12*a***.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An animal repellent trash bag comprising, an elongate flexible bag with an upper bag perimeter defining an opening, the opening including a closure means operatively associated therewith for selective closure of the bag, and a covering means securable to an interior surface of the bag spaced above a floor of the bag wherein the covering is securable to the interior surface in a first position to define a compartment enclosing a quantity of animal repellent and deodorizing granules therein, and the covering means removable from the bag to expose the granules and direct a deposit of the granules interiorly of the bag, and wherein a covering means includes a cover strip, and the cover strip including a first adhesive surface formed at least about a perimeter of the cover strip on an interior surface of the cover strip, and wherein the first adhesive surface is securable to a second adhesive surface of complementary configuration with the first adhesive surface formed on the interior surface of the trash bag, and wherein the closure means includes a layer of the trash bag overfolded about the upper perimeter to define a discontinuous conduit, the discontinuous conduit including an elongate flexible drawstring of a predetermined finite length, and wherein the cover strip is adhesively secured about its entire interior surface to overlie the overfolded layer and the interior surface of the trash bag, and the overfolded layer including a series of apertures therein, and the conduit including the animal repellent and deodorizing granules whereupon removal of the cover strip enables the granules to be directed through the apertures for deposit interiorly of the bag.

* * * * *